US005463186A

United States Patent [19]

Schricker

[11] Patent Number: 5,463,186

[45] Date of Patent: Oct. 31, 1995

[54] ROUND ELECTRICAL CABLE

[76] Inventor: Ulrich Schricker, Am Kreuzacker 13, D-91154 Roth, Germany

[21] Appl. No.: 208,456

[22] Filed: Mar. 8, 1994

[30] Foreign Application Priority Data

Mar. 8, 1993 [DE] Germany ..... 9303370 U

[51] Int. Cl.[6] ..... H01B 7/08; H01B 7/34

[52] U.S. Cl. ..... 174/36; 174/113 R; 174/117 F

[58] Field of Search ..... 174/117 R, 117 F, 174/113 R, 36

[56] References Cited

U.S. PATENT DOCUMENTS

| | | | |
|---|---|---|---|
| 3,775,552 | 11/1973 | Schumacher | 174/105 R |
| 3,836,415 | 9/1974 | Hilderbrandt | 174/117 F |
| 4,486,619 | 12/1984 | Trine et al. | 174/34 |
| 4,576,662 | 3/1986 | Lemke | 174/117 F |
| 4,767,891 | 8/1988 | Biegon et al. | 174/34 |
| 4,963,222 | 10/1990 | Bonjour et al. | 174/117 F |
| 5,053,583 | 10/1991 | Miller et al. | 174/36 |
| 5,162,611 | 11/1992 | Nichols, III et al. | 174/36 |
| 5,216,202 | 6/1993 | Yoshida et al. | 174/36 |
| 5,276,759 | 1/1994 | Nguyen et al. | 174/117 F |
| 5,342,991 | 8/1994 | Xu et al. | 174/117 R |

FOREIGN PATENT DOCUMENTS

| | | | |
|---|---|---|---|
| 487354 | 5/1992 | European Pat. Off. | 174/117 F |
| 8307764 | 3/1983 | Germany . | |
| 8322828 | 8/1983 | Germany . | |
| 9113530 U | 10/1991 | Germany . | |
| 5290645 | 11/1993 | Japan | 174/117 F |
| 1417209 | 12/1975 | United Kingdom | 174/117 F |

*Primary Examiner*—Morris H. Nimmo
*Attorney, Agent, or Firm*—Victor M. Genco, Jr.

[57] ABSTRACT

A round cable is provided formed from at least one ribbon cable which has been twisted into a round shape and in which the ribbon cable comprises a plurality of electrical conductor elements arranged to be parallel and adjacent each other. A ribbon cable is also provided.

18 Claims, 1 Drawing Sheet

ROUND ELECTRICAL CABLE

FIELD OF THE INVENTION

The invention relates to a round electrical cable comprised of at least one ribbon cable twisted into a round shape, wherein the ribbon cable comprises a plurality of electrical conductor elements arranged to be parallel and adjacent each other.

BACKGROUND OF THE INVENTION

Cables which contain a large number of electrical conductors require the cutting and clamping techniques to be used on the final cable because it saves costs and time. This technique requires that flat plug connectors be used which comprise one or more rows of contact elements that are arranged adjacent to each other and which are provided with cutting and clamping slots that are open at one side. The individual electrical connectors to be connected are pressed into the matching cutting/clamping slot together with their insulation material. At the same time, the slotted walls cut through the insulation and engage with the electrical conductor. This creates a durable electrical and mechanical connection between the electrical conductor and the matching contact element. Since all electrical conductors can be pressed into their matching cutting/clamping slots at the same time, this connection method constitutes a typical mass connection technique. For example, all 68 contacts of a 68-pole flat plug connector can be contacted in a single step. The time saving potential however applies only if ribbon cables of exact grid dimensions are used. Similar concerns also apply to connectors based on other connection techniques than the cutting/clamping technique. In contrast to round cables, these ribbon cables, however, have the shortcoming that they can be bent in one plane only and there are only very limited electrical shielding possibilities. It is, for instance, very difficult to apply a homogenously dense braided shield around a ribbon cable.

Typically, in order to overcome these problems, round cables have been used which either consisted of ribbon cables or which were provided with pre-harnessed, ribbon-cable-like cable ends.

Cables whose conductors or conductor elements herein defined as insulated wires or stranded wires, coaxial cables or twisted conductor pairs, which have been transformed into round cables by conventional stranding procedures cause problems in the connection to electrical connectors such as when the cutting/clamping technique is used. After the cable jacket and, if necessary, the cable shield and interim covers have been removed, the individual conductors or conductor elements spread apart in a disorganized way without staying within certain grid dimensions. Before they can be connected using the clamping and cutting techniques, the conductors must first be aligned next to each other so that they conform to the grid dimensions of the cutting and clamping slots of the flat plug connector. It is therefore quite common for cable manufacturers to cut the cables to the required lengths and supply them with pre-harnessed ends. For this purpose, the cable jacket insulation material, if any, must first be removed and subsequently the individual conductors must be aligned in parallel to each other at the cable ends and then insulating sleeves of the individual conductors must be thermally glued together or glued in parallel onto a film. One example is shown in U.S. Pat. No. 4,576,662. The disadvantage of this pre-harnessing step at the cable manufacturers is that pre-determined cut-to-size cable lengths must be used. Furthermore, the parallel alignment and bonding of the conductors is very time-consuming and the accuracy of the grid dimensions obtained is not very high. To overcome these problems, round cables formed from a ribbon cable are used.

One variant includes round cable which contains a Z-shaped or similarly folded extruded or laminated ribbon cable. The result is, however, not a truly round cable, but rather a ribbon cable which is less wide, yet thicker than an unfolded ribbon cable. As a consequence, the flex behavior in the different directions varies. Furthermore, the total diameter is larger. The Z-folds bend the ribbon cable and cause local expansions, which in turn change the grid dimensions.

U.S. Pat. No. 5,053,583 relates to a ribbon cable which comprises several cables of different diameters and structures that are embedded in an insulating material and to which a round shape has been imparted by folding and/or winding of the ribbon cable and by surrounding this construction with a cable jacket. As a consequence, an air core remains in the middle of this round cable or the middle is filled with conductors of larger diameters after having been cut off to separate them from the ribbon cable.

In another variant, DE-8322828 UI relating to an extruded or laminated ribbon cable is spirally wound around a carrier element of circular cross-section to produce a round cable. The shortcoming of this method is that the diameter of the round cable is much larger than that of comparable normal round cables. Furthermore, this design causes the cable less flexibility.

Another variant is described in DE-8307764 UI. This round cable is made from an extruded ribbon cable which has been twisted into a round cable shape and around whose circumference a metallic shield was wound which was then surrounded by an insulating outer jacket. This round cable, too, has a larger diameter than a comparable normal round cable. Since the individual conductors were embedded into a single, ribbon-shaped insulation material during the extrusion process, the conductors are much more difficult to displace relative to each other than the independent individual wires of a normal round cable. As a consequence, an air core in the middle of this round cable is virtually unavoidable.

What all round cables made from an extruded or laminated ribbon cable have in common is the fact that no deviations from the predetermined grid dimensions are admissible.

In German Utility Model application, G9113530.6, a round electrical cable is formed when a ribbon cable is twisted into a round shape. The ribbon cable comprises a plurality of electrical conductor elements arranged in parallel and adjacent to each other wherein the conductor elements are attached to each other by means of weaving threads and/or bands.

The diameter of this cable is basically no larger than that of a comparable normal round cable; the flexibility is the same as for a comparable normal round cable; and the grid tolerance is much larger than for a conventional round cable comprising ribbon cables.

In this type of design, the individual conductor elements are not held together by lamination or extrusion but are held together by being woven to form a ribbon cable, resulting in a higher flexibility of the ribbon cable and having much greater freedom for the individual conductor elements to move within the ribbon cable than is achievable with laminated or extruded ribbon cables. The freedom of the individual conductor elements of the woven ribbon cable to move prevents the formation of substantial cavities when the cable is twisted into a round shape and thus minimizes the diameter of the round cable. The weaving together of the ribbon cable prevents high expansion or joint forces while the cable is twisted into its round shape, as occurs with extruded or laminated ribbon cables.

The weaving together of the individual conductor elements to form a single ribbon cable is technically so complex that it is not adequate for some cable types. The usual material for weaving threads or bands is not suitable to influence the electrical properties of the cable, which is frequently desired.

There is a need for a round cable which can be produced from a ribbon cable, which has the benefits of the round cable obtained by weaving and twisting, yet can be produced at less technical expense and allows for a better control of the electrical properties of the round cable.

SUMMARY OF THE INVENTION

A round electrical cable is provided formed from at least one ribbon cable that has been twisted into a round cable and wherein the ribbon cable comprises a plurality of electrical conductor elements that are arranged adjacent to each other and held in place by a carrier tape characterized in that the carrier tape consists of a soft material and that the conductor elements are arranged at a certain distance from each other at least at one side of the carrier tape and are attached to the carrier tape over a relatively small area of their outer circumference. The carrier tape may be of a soft textile-like material and may be made from expanded polytetrafluoroethylene, polytetrafluoroethylene, polyurethane, polyvinylchloride, elastomers, silicones, natural rubber, and coated fabrics. Electrically conductive particles may also be embedded in the carrier tape. The electrically conductive particles include carbon, copper, silver, aluminum, and metal alloys such as nickel-iron alloys. The carrier tape may contain between 20 to 70% and preferably 40%, by volume of electrically conductive particles. The adjacent conductor elements of the ribbon cable are positioned so that a minimum distance is between them and wherein that distance equals at least the largest diameter. The conductor elements are selected from the group including insulated wires, stranded wires, twisted conductor pairs, and coaxial cables. The round cable may be surrounded by at least one round outer jacket. The round cable may also be surrounded by an electrical shield as well as an outer jacket. A ribbon cable is also provided.

DETAILED DESCRIPTION OF PREFERRED EMBODIMENTS

Figure 1:
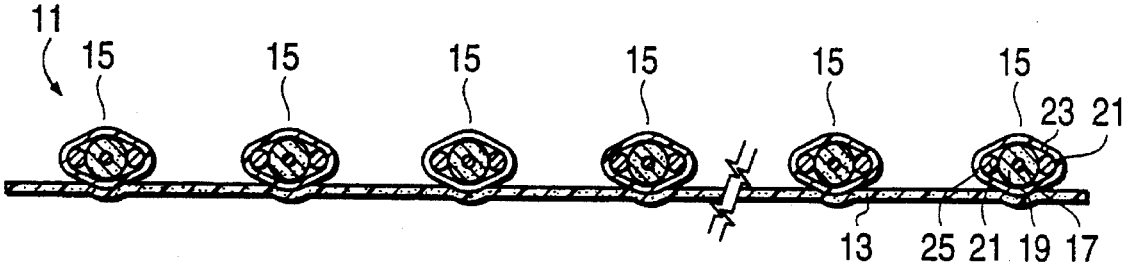
FIG. 1 shows a ribbon cable having a plurality of conductor elements attached to a carrier tape having a specific distance between each conductor element.

An electrical ribbon cable, and a round cable are provided wherein a ribbon cable is formed from a carrier of a soft tape and conductor elements that are arranged at least on one side of the carrier tape at a certain distance from each other and held attached to the carrier tape over a relatively small area of their outer circumference.

The soft tape-shaped carrier is used as a holder for the conductor elements. The individual conductor elements are not embedded in the carrier material but are attached only over a relatively small part of their circumference to one side of the soft carrier tape. This enables the carrier and conductor elements to be twisted into a round cable as easily as if they were only conductor elements to be stranded into one round cable. This is also ensured because the individual conductor elements are attached to the carrier tape at a distance from each other. Preferably the distance between adjacent conductor elements equals at least the maximum diameter of these conductor elements. When the cable is twisted into a round shape, the folding may ensue in both normal directions of the carrier tape. Due to the large and defined distances between the individual conductor elements, it is very easy to correctly insert the conductor elements into the chambers of a plug connector or into a stencil such that the individual round conductors can be arranged to match to the grid distance of a connector. The conductors are attached to the carrier by thermal fusion of the carrier and jacket around the conductor or by the use of adhesives such as polyester adhesives.

Preferably a carrier material is used which is ductile at least in the longitudinal direction of the conductor elements. As a consequence, the individual conductor elements of a cable whose end area is open for the purpose of connecting it to a plug connector, can be longitudinally displaced relative to each other in the transitional area between the round cable structure and the opened ribbon cable structure. The free ends of the individual conductor elements may be longitudinally displaced relative to each other. This prevents mechanical tension and load in the transitional area as would occur in round cables which have been made from ribbon cables and which comprise conductor elements embedded into an insulating material.

Several ribbon cables which are held on separate carrier tapes can be twisted into one joint round cable, for example, to improve handling and arrangement of the individual conductor elements.

For a carrier tape which consists of a carrier material that is ductile also in the transverse direction to the conductor elements, a particularly high degree of flexibility is achieved for connecting the conductor elements of the round cable to plug connectors with connection or contact elements of different grid distances.

The soft material of the carrier allows the ribbon cable to be easily undone into individual conductors for the purpose of connection to contact elements of a connector. This would be much more difficult with round cables made from conventional ribbon cables wherein the conductor elements are embedded into a relatively rigid and strong insulation material.

The soft material of the carrier preferably a soft textile feel so that it can be folded in both directions without problems and without obstructions as would occur with conventional ribbon cables where the conductor elements are embedded in the insulation material.

It is particularly preferred that the carrier tape material contain particles that are embedded into the material which influences the electrical properties of the cable. Preferred embedding materials include electrically conductive materials such as carbon, copper, silver, aluminum and metal alloys containing 74–77% nickel, 5% copper, 3–4% molybdenum or 1.5–2% chrominum, and 16.5–12% iron. Alternatively, a combination of these materials can be embedded into the carrier tape material together. The degree of filling into the material is dependent on the desired electrical properties achieved. A preferred degree of filling ranges from 20 to 70% by volume of the embedded material relative to the carrier tape material, and a particularly preferred degree of filling is about 40%. Furthermore, dielectrically effective materials, such as glass particles, may be embedded.

In general, the filling degree should be in a range where the electrical resistance between the conductor elements is still high enough and where the attenuation and shielding effects are sufficient. The attenuation effects act against resonance effects within a cable, namely between the individual conductors and/or conductor elements and a shield and/or several shields. For conductor elements in the form of coaxial cables, standing waves can be produced between adjacent coaxial cables. These can be absorbed due to the attenuation effect of the electrically conductive particles embedded into the carrier tape material. Such resonance effects cannot be prevented by conventional metal shields surrounding the conductor elements of the round cable or groups of such conductor elements. Such shields afford a protection against interfering radiation from outside into the conductor elements or against interfering radiation from the conductor elements outwards. However, they are not able to eliminate interfering resonance effects of the above-mentioned type which occur between adjacent conductor elements.

The selection of the filling material embedded into the carrier tape material depends on whether the attenuation needs to be effective more in the low-frequency or more in the radio frequency range. Filler materials, such as metal alloys, attenuate in the low frequency range, but hardly so in the upper frequency range. Filler materials, such as carbon, copper and silver, are effective at high frequencies, but not so at low frequencies.

Expanded polytetrafluoroethylene (ePTFE) is a particularly preferred carrier tape material. Further materials which are particularly suitable as carrier tape materials include PTFE, polyester, polyurethane, PVC, elastomers, silicones, natural rubber, coated fabrics (coated with one of the above-mentioned materials), each of them in soft form and preferably expandable in the transverse and/or longitudinal direction.

The conductor elements may be insulated wires, stranded wires, twisted conductor pairs, coaxial cables and/or conductors known as tri-leads. The term tri-lead denotes a coaxial cable of non-concentric cross-section wherein a round inner conductor is surrounded by a concentric dielectric consisting of an insulating material. A drain wire extends at two opposite sides of the outer circumference of the concentric dielectric in the longitudinal direction of the cable. A shielding film consisting of an electrically conductive material may be arranged around the concentric dielectric and two drain wires. This film is surrounded by a cable jacket consisting of an insulating material.

The individual conductor elements are preferably held attached to the carrier tape over a circumferential area of about 5–40% of their outer circumference. A circumferential area of about 20% is particularly preferred. This ensures a good foldability of the carrier tape with the conductor elements attached thereto.

The ribbon cable which has been twisted into a round shape may be surrounded by at least one outer jacket consisting of an insulating material. At least one electrical shield consisting of a wrapped or braided wire, or a electrically conductive material or metallized plastic tape may be arranged between the ribbon cable twisted into the round shape and the outer jacket.

The flexibility of the round cable is equivalent to that of a cable comprising individual stranded elements. The yard goods for the inventive round cables may be cut to any desirable length. The round cable may be unwound to open to yield the original ribbon cable. This ribbon cable has improved movability of the individual conductor elements which provides for easy and exact positioning of the individual conductor elements in the guiding grooves of a flat plug connector designed for the cutting/clamping technique and connections using the cutting/clamping technique for both single grid dimensions as well as grid dimensions in the range of between about 1.25 and 5 mm.

The invention is best understood with reference to the accompanying figures.

FIG. 1 shows a ribbon cable 11 comprising a carrier tape 13 consisting of a soft, ductile material, preferably expanded PTFE, on one side of which a number of conductor elements 15 are arranged in parallel and at a certain distance from each other. Each conductor element is attached to the carrier tape 13 with only a relatively small area of its outer circumference.

The embodiment shown in the figure shows a tri-lead as the conductor element. This is a coaxial cable with an inner conductor 17 concentrically surrounded by a dielectric 19. A drain wire 21 extends at two opposite sides of the outer circumference of the dielectric 19. The dielectric 19 and the drain wires 21 are surrounded by a metal or metallized shield film 23 which in turn is covered by a plastic jacket material 25. The drain wires 21 are in electrical contact with the film shield 23. They are provided because it is easier to connect the drain wires 21 at the cable end with the connection or contact elements of an electrical connector than to do this with the shielding film 23.

The distance between adjacent conductor elements 15 equals at least the maximum diameter of a single conductor element. This ensures that the carrier tape 13 can be folded without being obstructed by too narrow spaces between adjacent conductor elements.

The ribbon cable 11 as shown in FIG. 1 is suitable for applications where softness and good foldability of a ribbon cable are critical. It is particularly suitable for being twisted into a round cable as shown in FIG. 2.

Figure 2:
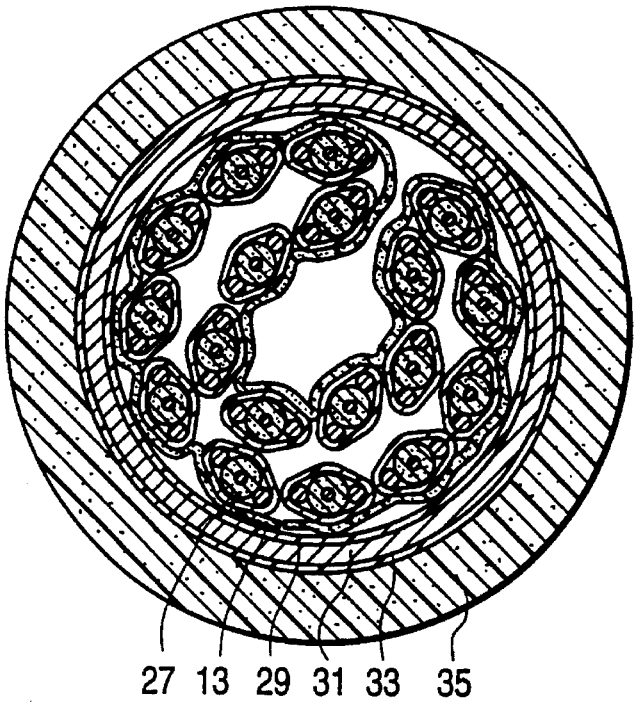
FIG. 2 shows a round cable obtained by twisting the ribbon cable shown in FIG. 1 into a round shape.

The round cable whose cross-section is shown in FIG. 2 contains a twisted ribbon cable 11 with a carrier tape 13 on which a number of signal cables 27 are attached in the form of tri-lead cables of the type shown in FIG. 1. An area in the middle of the carrier tape 13 is located in the middle between the signal cables 27. An outer area of the carrier tape 13 encloses the signal cables 27. The ribbon cable 11 is concentrically enclosed by a binder 29 which holds the twisted ribbon cable in its round shape. In the embodiment shown, the binder 29 is concentrically surrounded by a shield 31. This shield is optional and may consist of a braided shield, a film, or an electrically conductive material. The shield 31 is again concentrically surrounded by a binder 33 which is enclosed by a jacket 35 that consists of an insulating material. The jacket, too, is optional. As previously described, expanded PTFE is a particularly preferred material for the carrier tape. Conventional state of the art materials may be used for the individual conductors, signal cable layers 27, for the binders 29, 33 and for the shield 31 and the jacket 35.

I claim:

1. A round electrical cable formed from at least one ribbon cable which has been twisted into a round shape, and wherein the ribbon cable comprises a plurality of electrical conductor elements which are arranged adjacent to each other and held in place by a carrier tape of expanded polytetrafluoroethylene whereupon the conductor elements are arranged at a certain distance from each other at least on one side of the carrier tape and are attached to the carrier tape over a relatively small area of their outer circumference.

2. A round cable of claim 1 wherein the carrier tape is ductile in the longitudinal direction.

3. A round cable of claim 1 wherein the conductor elements are attached to the carrier tape over a circumferential area of about 5% to 40%.

4. A round cable of claim 1 wherein adjacent conductor elements have a minimum distance from each other which equals at least their largest diameter.

5. A round cable of claim 1 wherein the conductor elements are selected from the group consisting of insulated wires, stranded wires, twisted conductor pairs and coaxial cables.

6. A round cable of claim 1 wherein the ribbon cable which has been twisted into a round shape is surrounded at least one round outer jacket.

7. A round cable of claim 6 wherein at least one electrical shield selected from the group including a wound wire, a braided wire, an electrically conductive metal, and an electrically conductive plastic tape is arranged between the ribbon cable twisted into the round shape and the outer jacket.

8. A round cable of claim 1 wherein the carrier tape is ductile in the transverse direction.

9. A round electrical cable formed from at least one ribbon cable which has been twisted into a round shape, and wherein the ribbon cable comprises a plurality of electrical conductor elements which are arranged adjacent to each other and held in place by a carrier tape characterized in that the carrier tape consists of a soft material having embedded therein electrically conductive particles, and whereupon said conductor elements are arranged at a certain distance from each other at least on one side of the carrier tape and are attached to the carrier tape over a relatively small area of their outer circumference.

10. A round cable of claim 9 wherein the electrically conductive material is embedded into the carrier tape material with a filling degree ranging from about 20 to 70 volume percent.

11. A round cable of claim 10 wherein the electrically conductive material is embedded into the carrier tape material with a filling degree of about 40 percent by volume.

12. A round cable of claim 9 wherein the electrically conductive particles embedded in the material of the carrier tape are selected from the material group including carbon, copper, silver, aluminum and metal alloys.

13. A round cable of claim 9 wherein the carrier tape is ductile in the transverse direction.

14. A round cable of claim 13 wherein the carrier tape is ductile over a circumferential area of about 20%.

15. A round cable of claim 9 wherein the carrier tape consists of a material which is selected from a material group consisting of:

polytetrafluoroethylene, expanded porous polytetrafluoroethylene, polyester, polyurethane, elastomers, silicones, natural rubber, and coated fabrics.

16. A ribbon cable having a plurality of electrical conductor elements arranged parallel and adjacent to each other, and held in place by means of a carrier, characterized in that the carrier is a soft carrier tape and the conductor elements are arranged at least on one side of the carrier tape at a certain distance from each other and are attached to the carder tape over a relatively small area of their outer circumference, wherein electrically conductive particles are embedded within the material of the carrier tape, the electrically conductive particles being selected from a group consisting of carbon, copper, silver, aluminum, and metal alloys.

17. A ribbon cable of claim 16 wherein the conductor elements are selected from the group consisting of stranded wires, twisted conductor pairs, and coaxial cables.

18. A ribbon cable of claim 16 wherein the carrier tape consists of a material which is selected from a material group consisting of:

polytetrafluoroethylene, expanded porous polytetrafluoroethylene, polyester, polyurethane, elastomers, silicones, natural rubber, and coated fabrics.

* * * * *